US010352268B2

(12) United States Patent
Bischofberger et al.

(10) Patent No.: US 10,352,268 B2
(45) Date of Patent: Jul. 16, 2019

(54) METHOD FOR PRODUCING A CAST COMPONENT WITH AN INSERT

(71) Applicant: Mahle International GmbH, Stuttgart (DE)

(72) Inventors: Ulrich Bischofberger, Esslingen (DE); Stefan Gaiselmann, Stuttgart (DE)

(73) Assignee: Mahle International GmbH (DE)

( * ) Notice: Subject to any disclaimer, the term of this patent is extended or adjusted under 35 U.S.C. 154(b) by 105 days.

(21) Appl. No.: 15/588,029

(22) Filed: May 5, 2017

(65) Prior Publication Data

US 2017/0234261 A1 Aug. 17, 2017

Related U.S. Application Data

(62) Division of application No. 15/026,956, filed as application No. PCT/EP2014/070438 on Sep. 25, 2014, now Pat. No. 9,670,870.

(30) Foreign Application Priority Data

Oct. 2, 2013 (DE) ..... 10 2013 219 989

(51) Int. Cl.

| | |
|---|---|
| ***B22C 3/00*** | (2006.01) |
| ***F02F 1/00*** | (2006.01) |
| ***B22D 19/00*** | (2006.01) |
| ***B22C 9/22*** | (2006.01) |
| ***B22D 15/02*** | (2006.01) |

(Continued)

(52) U.S. Cl.

CPC ..... *F02F 1/004* (2013.01); *B22C 3/00* (2013.01); *B22C 9/22* (2013.01); *B22D 15/02* (2013.01); *B22D 19/0009* (2013.01); *B22D 19/0027* (2013.01); *B22D 19/0081* (2013.01); *B22D 21/007* (2013.01); *C22C 21/06* (2013.01); *F02F 3/0084* (2013.01); *F02F 2200/06* (2013.01)

(58) Field of Classification Search

CPC ... F02F 1/004; B22C 3/00; B22C 9/22; B22D 21/007; B22D 15/02; B22D 19/0081; B22D 19/009; C22C 21/06

USPC ..... 123/193.2

See application file for complete search history.

(56) References Cited

U.S. PATENT DOCUMENTS

| | | | |
|---|---|---|---|
| 4,273,835 A | 6/1981 | Higuchi | |
| 9,670,870 B2 * | 6/2017 | Bischofberger | ... B22D 19/0009 |

(Continued)

FOREIGN PATENT DOCUMENTS

| | | |
|---|---|---|
| DE | 19745725 A1 | 1/1999 |
| DE | 10308561 A1 | 9/2004 |

(Continued)

OTHER PUBLICATIONS

English abstract for JP2010-156003.

(Continued)

*Primary Examiner* — Marguerite J McMahon

(74) *Attorney, Agent, or Firm* — Fishman Stewart PLLC

(57) ABSTRACT

A cylinder liner for an internal combustion engine may include an aluminum alloy material including a magnesium content of at least 0.3% by weight, a liner body having a circumferential face, and an adapter layer of silicon oxide disposed on the circumferential face. The adapter layer may include at least one of a potassium oxide content and a sodium oxide content of greater than or equal to 0% by weight.

19 Claims, 2 Drawing Sheets

(51) Int. Cl.

| | |
|---|---|
| ***B22D 21/00*** | (2006.01) |
| ***C22C 21/06*** | (2006.01) |
| ***F02F 3/00*** | (2006.01) |

(56) References Cited

U.S. PATENT DOCUMENTS

| | | | | |
|---|---|---|---|---|
| 2004/0121170 | A1* | 6/2004 | Ackerman | C23C 4/18 428/469 |
| 2009/0258140 | A1 | 10/2009 | Bucher | |
| 2013/0256143 | A1 | 10/2013 | Schroth et al. | |

FOREIGN PATENT DOCUMENTS

| | | | |
|---|---|---|---|
| DE | 102004049413 | A1 | 4/2006 |
| DE | 102005041410 | A1 | 3/2007 |
| EP | 1110644 | A1 | 6/2001 |
| JP | 2002-205158 | A | 7/2002 |
| JP | 2010-156003 | A | 7/2010 |

OTHER PUBLICATIONS

German Search Report for DE-102013219989.9, dated Apr. 15, 2014.
English abstract for DE-10308561A1.
English abstract for DE-19745725A1.
English abstract for DE-102004049413A1.
Translation of Japanese Office Action, Patent Application No. 2016-520068, dated Oct. 11, 2016.
Japanese Office Action, Patent Application No. 2016-520068, dated Oct. 11, 2016.

* cited by examiner

METHOD FOR PRODUCING A CAST COMPONENT WITH AN INSERT

CROSS-REFERENCE TO RELATED APPLICATIONS

This application is a divisional of U.S. Ser. No. 15/026,956 filed Apr. 1, 2016, which is a National Stage of PCT/EP2014/070438, filed Sep. 25, 2014, which claims priority to German Patent Application No. 10 2013 219 989.9, filed Oct. 2, 2013, the contents of which are all hereby incorporated by reference in their entirety.

TECHNICAL FIELD

The invention relates to a method for producing a cast component, and to a cylinder liner, and to a cylinder block which contains a cylinder liner of this type for an internal combustion engine. Furthermore, the invention relates to a piston ring carrier and to a piston which contains a piston ring carrier of this type for an internal combustion engine.

BACKGROUND

Cylinder blocks of modern internal combustion engines are produced as a rule in a casting process. Since the material which is used for the cylinder block (as a rule, aluminum or iron, but magnesium/aluminum composite materials may also be suitable) is not capable of meeting the tribological requirements necessary for a friction-free and therefore as far as possible wear-free movement of piston in the cylinder, what are known as cylinder liners are used in the cylinders. They have the required tribological properties and, as a consequence, ensure largely wear-free long-term operation of piston in the cylinder block; cylinder liners of this type are frequently provided with a circumferential face which is roughened, grooved or machined in a similar way. As an alternative to this, the prior art also teaches the application of an aluminum spray coating to the circumferential face of the cylinder liner. In both cases, a particularly positively locking connection of the cylinder liner to the cylinder block can be produced during the casting encapsulation (likewise known from the prior art) of the cylinder liner with an aluminum alloy.

In an analogous way, the production of pistons for internal combustion engines of this type also as a rule takes place by means of a casting process. What are known as piston rings (as a rule made of steel) are used to seal the piston against the cylinder block, which piston rings can be inserted into a circumferential groove which is provided on a circumferential face of the piston, in order to produce said sealing effect. In order then to reduce the tribological loading of the piston, the piston material of which consists as a rule of a lightweight aluminum alloy, with respect to the piston ring which is formed from a steel, what are known as piston ring carriers are used in conventional pistons, which piston ring carriers are encapsulated by casting with the actual piston in one casting operation. As a consequence, there is no more direct piston/piston ring boundary surface which is critical for wear to a particular extent; rather, said piston ring carrier then acts as a mechanical "interface" between the piston ring and the actual piston, the circumferential groove for receiving the piston ring then being provided on the piston ring carrier.

U.S. Pat. No. 4,273,835 describes the production of a cylinder block with a cylinder liner which is inserted into the cylinder of the cylinder block. A silicone resin layer for sealing a water jacket is provided between the cylinder liner and the cylinder block.

JP 2010-156003 A describes the coating of a workpiece made of cast iron with an adapter layer which contains carbon, manganese, silicon, sulfur and phosphorus. The adapter layer increases the bond strength of an aluminum alloy which is applied to the workpiece.

A particularly positively locking connection between the cylinder liner and the cylinder block and between the piston ring carrier and the piston (in the following text, the two components are in each case called an "insert part" and "cast component" in generalized terms) arises, however, if what is known as an aluminum high pressure die casting process is used for casting encapsulation of the insert part with an aluminum alloy, which process is however increasingly dispensed with (often for cost reasons) during the production of modern internal combustion engines in favor of low pressure die casting techniques or gravity die casting techniques. By means of low pressure or gravity die casting techniques, the quality of the positively locking connection of the insert part with the cast component which can be achieved if the aluminum high pressure casting process is used cannot be even remotely achieved, however.

A positively locking connection which is not developed in an optimum way between the insert part and the cylinder block leads, however, as a rule to merely reduced thermal coupling of the insert part to the cast component, which in turn can result in undesired, thermally induced mechanical stresses in the insert part and/or in the cast component.

Against this background, EP 1 110 644 A1 concerns a method for producing a cylinder crankcase, in which an insert part in the form of a cylinder liner has surfaces which are to be encapsulated by casting and are provided with a silicon oxide layer. According to the method, the insert part is cast into an aluminum alloy.

SUMMARY

The present invention is concerned with the problem of specifying an improved embodiment for a method for producing a cast component and for an insert part which no longer has the abovementioned disadvantages.

This problem is solved by way of the subject matter of the independent patent claims. Preferred embodiments are the subject matter of the dependent claims.

It is accordingly a basic concept of the invention to coat the circumferential face of an insert part during the production process, to be precise by means of a layer made of silicon oxide which is called an adapter layer in the following text. During casting encapsulation with an aluminum alloy, in particular using the aluminum high pressure die casting which was introduced at the outset after being inserted into a suitable casting mold, said adapter layer leads to an improved wetting behavior of the aluminum alloy on the adapter layer. Corresponding experimental tests have shown that this applies, however, only to the case where the aluminum alloy is provided with a magnesium proportion of at least 0.3% by weight, preferably of at least 0.5% by weight. As a consequence of the improved wetting properties of the aluminum alloy on the silicon oxide of the adapter layer, a particularly positively locking connection can be achieved between the cylinder liner and the aluminum alloy, which connection completes the insert part with respect to the cast component.

A particularly positively locking connection results if the adapter layer according to the invention is used not only in the case of what is known as the aluminum high pressure die casting process, but rather also in the case of the low pressure or gravity die casting process. As a result of the adapter layer, the quality of the positively locking connection of the insert part to the cast component which can be achieved if the aluminum high pressure die casting process is used can also be achieved by means of low pressure or gravity die casting techniques.

The method which is proposed here affords particular advantages, in particular, if the insert part is a cylinder liner and the cast component is a cylinder block for an internal combustion engine, or if the insert part is a piston ring carrier and the cast component is a piston for an internal combustion engine.

Step b) of the method according to the invention, according to which the circumferential face is coated with an adapter layer made of silicon oxide, can preferably comprise the following two substeps b1) and b2):

b1) application of a silicone resin to the circumferential face, b2) curing of the silicone resin to form silicon oxide by way of heating of the insert body.

Silicone resin is commercially obtainable in liquid form in large amounts and therefore inexpensively. In addition, it can be applied in a simple way to the circumferential face of the cylinder liner before the latter is inserted into the cylinder block for casting. The transformation of the organic silicone resin into silicon oxide likewise proves to be very simple: to this end, it is sufficient to heat the insert component which is coated with silicone resin, for example to a temperature of 400° C. or more, and in this way to cure the silicone resin to form silicon oxide. The cured silicon oxide can react in the region of the boundary surface to the aluminum alloy with the magnesium which is contained in the aluminum alloy in accordance with the reaction equation $SiO_2$+2 Mg->2 MgO+Si, as a result of which the wetting of the surface can be improved decisively.

It proves expedient to a particular extent to dilute the silicone resin with a solvent before the application to the circumferential face according to step b1) of the method according to the invention; in this way, particularly homogeneous covering of the circumferential face with silicone resin takes place before the oxidation operation.

Particularly satisfactory results in the case of curing of the silicone resin to form silicon oxide and the associated curing of the oxidized silicon after being heated can be achieved if the silicone resin has a layer thickness of from 5 to 10 μm before the curing to form silicon oxide. It is true in general that a low layer thickness aids a rapid curing process, which can have an advantageous effect on the industrial manufacture of the insert parts in large numbers.

An alternative realization of the adapter layer according to the invention made of silicon oxide is afforded by the use of a solution of what is known as water glass. Here, all water-soluble sodium, potassium and silicon silicates which have solidified from a melt are covered under the term "water glass". They have glass-like, that is to say amorphous material properties. After dipping into the water glass solution, the cylinder liner is cured as described above in conjunction with silicone resin by way of heating of the insert part, preferably to a temperature of 400° C. or more. Here, the adapter layer loses its water component, with the result that a substantially water-free, polymerized inorganic silicate is produced. It is also the case according to this embodiment that the cured silicon oxide in the region of the boundary surface to the aluminum alloy can react with the magnesium which is contained in the aluminum alloy in accordance with the reaction equation $SiO_2$+2 Mg->2 MgO+Si, which leads to improved wetting of the surface.

The water glass particularly expediently comprises $Na_2O_3Si$, that is to say sodium silicate.

The invention also relates to a cylinder liner having a liner body which has a circumferential face, the circumferential face of the liner body being coated with an adapter layer made of silicon oxide. An adapter layer of this type expressly also comprises the above-described MgO and Si which are obtained by way of reaction of $SiO_2$ with Mg in the transition region of the adapter layer to the aluminum alloy.

Furthermore, the invention relates to a cylinder block having a cylinder liner of this type, and having an aluminum alloy which encases the adapter layer and completes the cylinder liner with respect to the cylinder block.

Furthermore, the invention relates to a piston ring carrier having a ring body which has a circumferential face, the circumferential face of the ring body being coated with an adapter layer made of silicon oxide.

Finally, the invention relates to a piston having a piston ring carrier of this type, and having an aluminum alloy which encases the adapter layer and completes the piston ring carrier with respect to the piston.

Further important features and advantages of the invention result from the subclaims, from the drawings and from the associated description of the figures using the drawings.

It goes without saying that the features which are mentioned in the above text and are still to be explained in the following text can be used not only in the respectively specified combination, but rather also in other combinations or on their own, without departing from the scope of the present invention.

Preferred exemplary embodiments of the invention are shown in the drawings and will be explained in greater detail in the following description, identical designations referring to identical or similar or functionally identical components.

BRIEF DESCRIPTION OF THE DRAWINGS

In the drawings, in each case diagrammatically.

DETAILED DESCRIPTION

Figure 1:
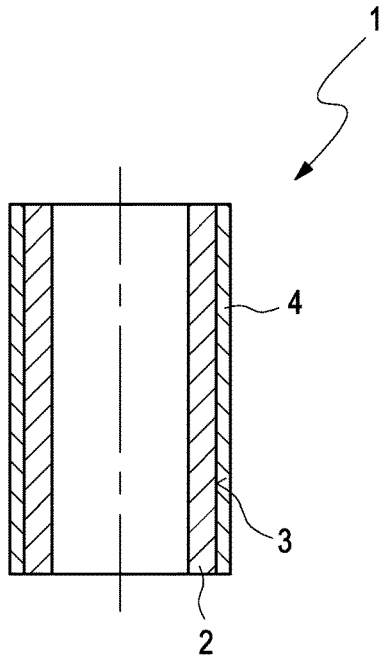
FIG. 1 shows a cylinder liner which is coated with silicon oxide before being inserted into a casting mold in order to produce a cylinder block.
Figure 2:
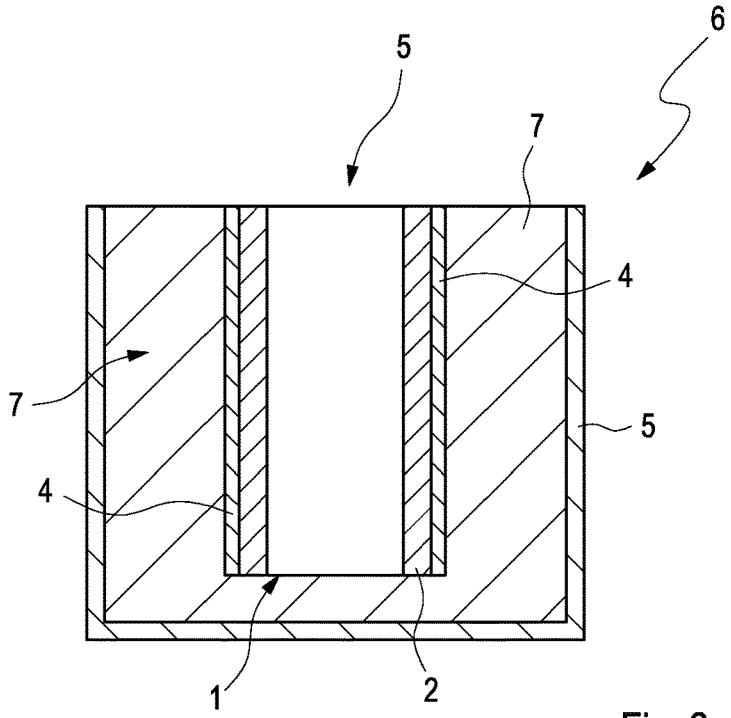
FIG. 2 shows a cylinder liner which is encapsulated by casting in a casting mold with an aluminum alloy and forms a cylinder block together with the aluminum alloy.

In each case in a roughly diagrammatic longitudinal section, FIGS. 1 and 2 illustrate the method according to the invention for producing a cast component 6 in the form of a cylinder block. FIG. 1 shows an insert part 1 in the form of a cylinder liner which has an insert body which has a circumferential face 3 and is called a liner body 2 in the exemplary scenario of FIGS. 1 and 2. As shown in FIG. 1, the liner body 2 can be of sleeve-like configuration. Before the liner body 2 is introduced into a casting mold (not shown in FIG. 1), its circumferential face 3 is coated with a layer of silicon oxide, called an "adapter layer" 4 in the following text.

According to a first variant, the application of an adapter layer 4 of this type takes place in two method steps: in a first step, a silicone resin is applied to the regions of the circumferential face 3 which are to be encapsulated by casting. In a second step, the silicone resin is cured to form silicon oxide by way of heating of the liner body 2. In order to transform the organic silicone resin into silicon oxide, the liner body 2 can be heated to a temperature of 400° C. or more, for example with the aid of a suitable furnace. It is true here in general that a low layer thickness aids a rapid curing process, which has an advantageous effect on the industrial manufacture of the cylinder liner in large numbers. Particularly satisfactory results during the oxidation of the silicone resin are achieved if the silicone resin which is applied to the circumferential face 3 has a layer thickness of from 5 to 10 μm before the curing to form silicon oxide. To this end, the silicone resin can be diluted by means of a solvent before the application to the circumferential face 3.

According to a second variant which is an alternative to the first variant, the application of the adapter layer 4 takes place by way of dipping of the cylinder liner into a solution of water glass. Here, all water-soluble sodium, potassium and silicon silicates which have solidified from a melt are covered by the term "water glass", in particular also $Na_2O_3Si$. Said silicates have glass-like, that is to say amorphous material properties. After dipping of the cylinder liner into a water glass solution of this type, the cylinder liner is dehydrated, that is to say cured, in an analogous manner to the first variant which is described in the preceding text, by way of heating of the cylinder liner, preferably to a temperature of 400° C. or more in order that predominantly silicon oxide remains.

The cylinder liner which is coated with silicon oxide in accordance with the two above-described variants can then be inserted into a casting mold 5 which is shown diagrammatically in FIG. 2. Finally, the cylinder liner is encapsulated by casting in a positively locking manner with an aluminum alloy 7 which completes the cylinder liner with respect to a cylinder block, said aluminum alloy 7 having a magnesium proportion of at least 0.3% by weight, preferably of at least 0.5% by weight. The adapter layer 4 of silicon oxide which is applied on the circumferential face 3 of the liner body causes the aluminum alloy 7 which is introduced into the casting mold 5 by means of aluminum high pressure die casting to exhibit an improved wetting behavior during casting encapsulation of the cylinder liner if the aluminum alloy 7 has a magnesium proportion of at least 0.3% by weight, preferably of at least 0.5% by weight. As a consequence, a particularly satisfactory positively locking connection is achieved between the cylinder liner and the aluminum alloy 7, which connection in turn ensures a pronounced heat transfer between said two components. The cured silicon oxide of the adapter layer can react in the region of the boundary surface to the aluminum alloy with the magnesium which is contained in the aluminum alloy in accordance with the reaction equation $SiO_2$+2 Mg->2 MgO+ Si, as a result of which the wetting of the surface can be improved decisively.

Figure 3:
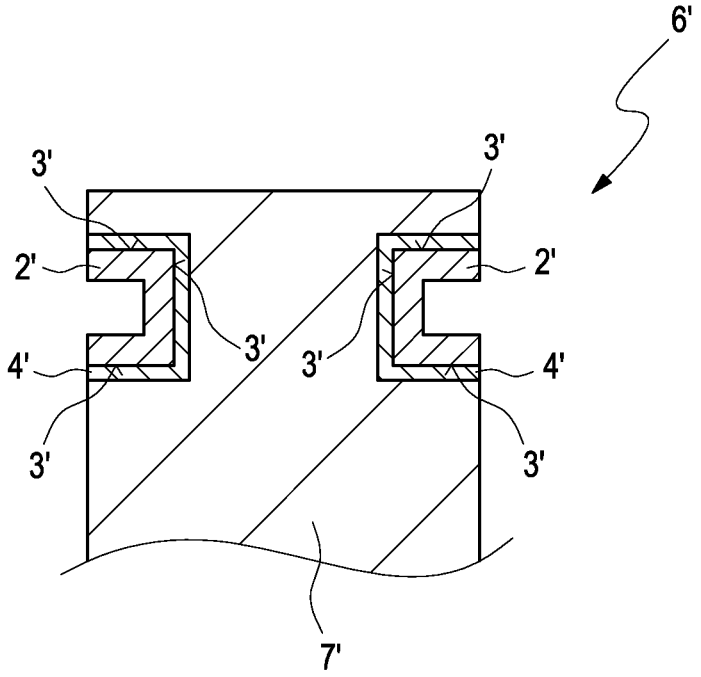
FIG. 3 shows a ring carrier which is encapsulated by casting with an aluminum alloy and forms a piston together with the aluminum alloy.

As a further, second exemplary application for the method according to the invention, FIG. 3 then shows a cast component 6' which is produced by means of the method according to the invention in the form of a piston for an internal combustion engine, in a roughly diagrammatic longitudinal section.

FIG. 3 shows an insert part which is denoted by 1' in the form of a piston ring carrier which has an insert body which has a circumferential face 3 and is denoted as ring carrier body 2' in the exemplary scenario of FIG. 3. Before the ring carrier body 2' is introduced into a casting mold (not shown in FIG. 3) for casting encapsulation with an aluminum alloy 7', its circumferential face 3' is coated with a layer of silicon oxide, in the following text called an "adapter layer" 4 in an analogous manner to the example of FIGS. 1 and 2.

The above explanations with respect to the exemplary scenario of FIGS. 1 and 2 apply mutatis mutandis to the application of the adapter layer 4' on the circumferential face; that is to say, in order to produce a piston in accordance with a first variant, first of all a silicone resin is applied to the regions of the circumferential face 3' which are to be encapsulated by casting, and said silicone resin is oxidized to form silicon oxide by way of subsequent heating of the ring carrier body 2'. According to a second variant, the application of the adapter layer 4' takes place by way of dipping of the piston ring carrier into a solution of water glass. After the dipping of the piston ring carrier into a water glass solution of this type, the latter is once again cured to form silicon oxide by way of heating of the piston ring carrier.

The piston ring carrier which is coated with silicon oxide in accordance with the two described variants is subsequently inserted into a suitable casting mold and is encapsulated in a positively locking manner by casting with an aluminum alloy 7' in said casting mold, which aluminum alloy 7' then completes the piston ring carrier 1' with respect to the piston, said aluminum alloy 7' having a magnesium proportion of at least 0.3% by weight, preferably of at least 0.5% by weight. The adapter layer 4' of silicon oxide which is applied on the circumferential face 3 of the ring carrier body 2' causes, in an analogous way to the example of FIGS. 1 and 2, the aluminum alloy 7' which is introduced into the casting mold by means of aluminum continuous casting to exhibit an improved wetting behavior during casting encapsulation of the piston ring carrier if the aluminum alloy 7' has a magnesium proportion of at least 0.3% by weight, preferably of at least 0.5% by weight. As a consequence, a particularly satisfactory positively locking connection of the piston ring carrier and the aluminum alloy 7' is achieved which in turn ensures a pronounced heat transfer between said two components.

The invention claimed is:

1. A cylinder liner for an internal combustion engine, the cylinder liner comprising:

an aluminum alloy material including a magnesium content of at least 0.3% by weight;

a liner body having a circumferential face; and an adapter layer of a silicon oxide material disposed on the circumferential face between the liner body and the aluminum alloy material, wherein the silicon oxide material of the adapter layer includes at least one of a potassium oxide content and a sodium oxide content of greater than 0% by weight.

2. The cylinder liner according to claim 1, wherein the magnesium content of the aluminum alloy material is at least 0.5% by weight.

3. The cylinder liner according to claim 1, wherein the adapter layer has a layer thickness of 5 μm to 10 μm.

4. The cylinder liner according to claim 1, wherein the adapter layer is encased by the aluminum alloy material.

5. The cylinder liner according to claim 4, wherein a transition region between the adapter layer and the aluminum alloy material has a composition including magnesium oxide and silicon.

6. The cylinder liner according to claim 1, wherein the silicon oxide material of the adapter layer includes a polymerized inorganic silicate.

7. The cylinder liner according to claim 1, wherein the silicon oxide material of the adapter layer is predominantly silicon oxide having a proportion of the potassium oxide content.

8. The cylinder liner according to claim 1, wherein the silicon oxide material of the adapter layer is predominantly silicon oxide having a proportion of the sodium oxide content.

9. The cylinder liner according to claim 1, wherein the silicon oxide material of the adapter layer is dehydrated water glass.

10. A cylinder block for an internal combustion engine, the cylinder block comprising:

an aluminum alloy component including a magnesium content of at least 0.3% by weight;

a cylinder liner including a liner body having a circumferential face;

an adapter layer of a silicon oxide material disposed on the circumferential face of the liner body, the silicon oxide material of the adapter layer including at least one of a potassium oxide content and a sodium oxide content of greater than 0% by weight; and wherein the aluminum alloy component encases the adapter layer.

11. The cylinder block according to claim 10, wherein the magnesium content of the aluminum alloy component is at least 0.5% by weight.

12. The cylinder block according to claim 10, wherein the adapter layer has a layer thickness of 5 μm to 10 μm.

13. The cylinder block according to claim 11, wherein the cylinder liner and the aluminum alloy component define a positively locking connection at a transition region between the adapter layer and the aluminum alloy component.

14. The cylinder block according to claim 13, wherein the transition region has a composition including magnesium oxide and silicon.

15. The cylinder block according to claim 11, wherein the silicon oxide material of the adapter layer has a proportion of the sodium oxide content.

16. The cylinder block according to claim 11, wherein the silicon oxide material of the adapter layer has a proportion of the potassium oxide content.

17. A cylinder liner of a cylinder block for an internal combustion engine, the cylinder liner comprising:

an aluminum alloy component including a magnesium content of at least 0.5% by weight;

a liner body having a circumferential surface;

an adapter layer of a silicon oxide material disposed on the circumferential surface, the silicon oxide material of the adapter layer including at least one of a potassium oxide content and a sodium oxide content; and wherein the aluminum alloy component encases the adapter layer, and wherein the adapter layer further includes a content of magnesium oxide and silicon to facilitate a positively locking connection between the liner body and the aluminum alloy component.

18. The cylinder liner according to claim 17, wherein the adapter layer has a layer thickness of 5 μm to 10 μm.

19. The cylinder liner according to claim 17, wherein the content of magnesium oxide and silicon is provided in the adapter layer via a reaction of the silicon oxide material with the magnesium content in a transition region between the adapter layer and the aluminum alloy component.

* * * * *